US010865362B2

(12) United States Patent
Reinoso Garcia et al.

(10) Patent No.: US 10,865,362 B2
(45) Date of Patent: Dec. 15, 2020

(54) PROCESS FOR MANUFACTURING MGDA/GLDA GRANULES, GRANULES, AND THEIR USE

(71) Applicant: BASF SE, Ludwigshafen am Rhein (DE)

(72) Inventors: Marta Reinoso Garcia, Ludwigshafen (DE); Michael Klemens Mueller, Ludwigshafen (DE); Carsten Sueling, Ludwigshafen (DE); Verena Mormul, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 15 days.

(21) Appl. No.: 16/316,266

(22) PCT Filed: Jul. 5, 2017

(86) PCT No.: PCT/EP2017/066705

§ 371 (c)(1),
(2) Date: Jan. 8, 2019

(87) PCT Pub. No.: WO2018/011027

PCT Pub. Date: Jan. 18, 2018

(65) Prior Publication Data

US 2020/0181537 A1 Jun. 11, 2020

(30) Foreign Application Priority Data

Jul. 15, 2016 (EP) ..... 16179707

(51) Int. Cl.

| | |
|---|---|
| ***C11D 3/33*** | (2006.01) |
| ***C11D 11/02*** | (2006.01) |
| ***C11D 17/00*** | (2006.01) |
| ***C11D 17/06*** | (2006.01) |

(52) U.S. Cl.
CPC ..... *C11D 3/33* (2013.01); *C11D 11/02* (2013.01); *C11D 17/0073* (2013.01); *C11D 17/06* (2013.01)

(58) Field of Classification Search
CPC ..... C11D 3/33; C11D 17/06; C11D 11/02
See application file for complete search history.

(56) References Cited

U.S. PATENT DOCUMENTS

| | | | | |
|---|---|---|---|---|
| 5,200,236 | A * | 4/1993 | Lang | C11D 3/39 252/186.25 |
| 2012/0248370 | A1* | 10/2012 | Oftring | C07C 227/26 252/182.12 |
| 2013/0284210 | A1* | 10/2013 | Hueffer | C11D 7/3245 134/25.2 |
| 2016/0221931 | A1 | 8/2016 | Reinoso Garcia et al. | |
| 2017/0058239 | A1 | 3/2017 | Hartmann et al. | |

FOREIGN PATENT DOCUMENTS

| | | | |
|---|---|---|---|
| DE | 19819187 | A1 | 11/1999 |
| EP | 0851023 | A2 | 7/1998 |
| WO | WO 2009/103822 | A1 | 8/2009 |
| WO | WO 2012/168739 | A1 | 12/2012 |
| WO | 2015036324 | * | 3/2015 |
| WO | WO 2015/036324 | A1 | 3/2015 |
| WO | WO 2015/121170 | A1 | 8/2015 |

OTHER PUBLICATIONS

Extended European Search Report dated Jan. 4, 2017 in Patent Application No. 16179707.1, 3 pages.
Extended European Search Report dated Apr. 1, 2017 in Patent Application No. 16179707.1, 3 pages.
International Search Report dated Oct. 5, 2017, in PCT/EP2017/066705, filed Jul. 5, 2017.

* cited by examiner

*Primary Examiner* — Charles I Boyer
(74) *Attorney, Agent, or Firm* — Oblon, McClelland, Maier & Neustadt, L.L.P.

(57) ABSTRACT

Process for manufacturing granules of salts of at least two aminopolycarboxylic acids (A), com-prising the steps of (a) providing an aqueous solution of (A1) at least one alkali metal salt of a mixture of L- and D-enantiomers of methyl glycine diacetic acid (MGDA), said mixture containing predominantly the respective L-isomer with an enantiomeric excess (ee) in the range of from 10 to 95%, (A2) at least one alkali metal salt of L- and D-enantiomers of glutamic acid diacetic acid (GLDA) or of enantiomerically pure L-GLDA, the weight ratio of (A1) and (A2) being in the range of from 1:9 to 9:1, (b) spray granulating said solution with a gas inlet temperature of at least 125° C. Additionally, the present invention relates to granules and to their use.

21 Claims, No Drawings

PROCESS FOR MANUFACTURING MGDA/GLDA GRANULES, GRANULES, AND THEIR USE

The present invention relates to a process for manufacturing granules of salts of at least two aminopolycarboxylic acids (A), comprising the steps of (a) providing an aqueous solution of (A1) at least one alkali metal salt of a mixture of L- and D-enantiomers of methyl glycine diacetic acid (MGDA), said mixture containing predominantly the respective L-isomer with an enantiomeric excess (ee) in the range of from 5 to 95%, (A2) at least one alkali metal salt of L- and D-enantiomers of glutamic acid diacetic acid (GLDA) or of enantiomerically pure L-GLDA, the weight ratio of (A1) and (A2) being in the range of from 1:9 to 9:1, (b) spray granulating said solution with a gas inlet temperature of at least 125° C.

Additionally, the present invention relates to granules with a residual moisture content in the range of from 5 to 15% by weight, containing (A1) at least one alkali metal salt of a mixture of L- and D-enantiomers of methyl glycine diacetic acid (MGDA), said mixture containing predominantly the respective L-isomer with an enantiomeric excess (ee) in the range of from 5 to 95%, (A2) at least one alkali metal salt of L- and D-enantiomers of glutamic acid diacetic acid (GLDA) or of enantiomerically pure L-GLDA, in molecular disperse form, the weight ratio of (A1) and (A2) being in the range of from 1:9 to 9:1.

Additionally, the present invention relates to their use.

Chelating agents of the aminopolycarboxylate type such as methyl glycine diacetic acid (MGDA) and glutamic acid diacetic acid (GLDA) and their respective alkali metal salts are useful sequestrants for alkaline earth metal ions such as $Ca^{2+}$ and $Mg^{2+}$. A lot of aminopolycarboxylates show good biodegradability and are thus environmentally friendly. For that reason, they are recommended and used for various purposes such as laundry detergents and for automatic dishwashing (ADW) formulations, in particular for so-called phosphate-free laundry detergents and phosphate-free ADW formulations.

Depending on the type of product—liquid home care and fabric care products versus solid home care and fabric care products—and the manufacturing process of solid home care and fabric care products care product manufacturers may either prefer to handle solutions of aminopolycarboxylates or solid aminopolycarboxylates, for example joint spray drying or solid mixing.

Powders and granules of aminopolycarboxylates may be shipped economically due to their high active ingredient content that goes along with low water content. Therefore, convenient processes for providing granules are still of great commercial interest.

Many industrial users wish to obtain complexing agents in aqueous solutions that are as highly concentrated as possible. The lower the concentration of the requested complexing agent the more water needs to be shipped. Such water adds to the costs of transportation, and it has to be removed later. Although about 40% by weight solutions of the trisodium salt of MGDA and up to 47% by weight solutions of tetrasodium salt of GLDA can be made and stored at room temperature, local or temporarily colder solutions may lead to precipitation of the respective complexing agent, as well as nucleating by impurities. Said precipitations may lead to impurities or inhomogeneity during formulation. Such impurities may be undesirable as well in case the MGDA or GLDA is solidified in a later step.

A general challenge of aminopolycarboxylates as chelating agents is their tendency to yellowing in the presence of peroxides and other oxygen bleaches such as perborate and especially percarbonate. Although percarbonates such as sodium percarbonate is usually provided in coated form yellowing is still a challenge.

In WO 2009/103822, a process is disclosed in which slurries are granulated that have a certain solids content, with a gas inlet temperature of 120° C. or less.

In WO 2012/168739, a process is disclosed wherein slurries of complexing agents are spray-dried under non-agglomerating conditions.

Both processes have their shortcomings. A low gas inlet temperature requires highly concentrated slurries or a huge amount of gas per unit of granule. A process using non-agglomerating conditions yields powders only.

In WO 2015/036324, mixtures of isomers of MGDA and their alkali metal salts are disclosed.

It was an objective of the present invention to provide a solid builder component for cleaning formulations that exhibits reduced yellowing in the presence of oxygen bleach. It was further an objective to provide a process for making a solid builder component for cleaning formulations that exhibits reduced yellowing in the presence of oxygen bleach. It was further an objective to provide applications.

Accordingly, the process and granules defined at the outset have been found, hereinafter also referred to as inventive process and inventive granules, respectively.

The inventive process is a process for manufacturing granules of salts of at least two aminopolycarboxylic acids (A), also referred to as chelating agents (A).

The term "granule" in the context of the present invention refers to particulate materials that are solids at ambient temperature and that preferably have an average particle diameter (D50) in the range of from 0.1 mm to 2 mm, preferably 0.4 mm to 1.25 mm, even more preferably 400 μm to 1 mm. The average particle diameter of inventive granules can be determined, e.g., by optical or preferably by sieving methods. Sieves employed may have a mesh in the range of from 60 to 3,000 μm.

In one embodiment of the present invention, granules may have a broad particle diameter distribution. In another embodiment of the present invention, granules may have a narrow particle diameter distribution. The particle diameter distribution can be adjusted, if desired, by multiple sieving steps.

Granules made by the inventive process may contain residual moisture, moisture referring to water including water of crystallization and adsorbed water. The amount of water may be in the range of from 5 to 15% by weight, preferably 5 to 10% by weight, referring to the total solids content of the respective powder or granule, and may be determined by Karl-Fischer-titration or by drying at 160° C. to constant weight with infrared light.

Granules made by the inventive process contain salts of at least two aminopolycarboxylic acids (A), wherein at least one salt is selected from alkali metal salts of MGDA and at least one salt is selected from alkali metal salts of GLDA, both being further defined below.

The inventive process comprises at least two steps, hereinafter referred to as step (a) and step (b). Step (a) is performed before step (b).

The inventive process starts by (a) providing an aqueous solution of salts of at least two aminopolycarboxylic acids (A).

For the naked eye, solutions such as aqueous solutions do not contain precipitates. Aqueous solutions in the context of the present invention may contain some organic solvent, for example 0.1 to 20% by volume, referring to the entire continuous phase. In a preferred embodiment, aqueous solutions do not contain significant amounts of organic solvent.

The liquid phase may also comprise one or more inorganic salts dissolved in the liquid phase, for example alkali metal hydroxide, alkali metal carbonate, alkali metal sulfate or alkali metal halide or a combination of at least two of the foregoing.

In one embodiment of the present invention, such aqueous solution according to step (a) has a pH value in the range of from 8 to 14, preferably from 9 to 13.5 and even more preferably at least 9.5. The pH value is determined at ambient temperature.

In a preferred embodiment of the present invention, aqueous solutions provided in step (a) have a total solids contents in the range of from 30 to 70%, even more preferred 45 to 65%.

Alkali metal salts of MGDA are selected from compounds according to general formula (I a)

$$[CH_3—CH(COO)—N(CH_2—COO)_2]M_{3-x}H_x \quad \text{(I a)}$$

wherein

M is selected from alkali metal cations, same or different, for example cations of lithium, sodium, potassium, rubidium, cesium, and combinations of at least two of the foregoing. Preferred examples of alkali metal cations are sodium and potassium and combinations of sodium and potassium.

x in formula (I a) is in the range of from zero to 1.0, preferred are zero to 0.5. In a particularly preferred embodiment, x is zero.

Examples of $M_{3-x}H_x$ are $Na_{3-x}H_x$, $[Na_{0.7}(NH_4)_{0.3}]_{3-x}H_x$, $[(NH_4)_{0.7}Na_{0.3}]_{3-x}H_x$, $(K_{0.7}Na_{0.3})_{3-x}H_x$, $(Na_{0.7}K_{0.3})_{3-x}H_x$, $(K_{0.22}Na_{0.78})_{3-x}H_x$, $(Na_{0.22}K_{0.78})_{3-x}H_x$, and $K_{3-x}H_x$. Preferred examples of $M_{3-x}H_x$ are selected from $Na_3$, $Na_2K$, $K_2Na$, $Na_{2.65}K_{0.35}$, $K_{2.65}Na_{0.35}$, $K_3$, $(K_{0.85}Na_{0.15})_{3-x}H_x$, and $(Na_{0.85}K_{0.15})_{3-x}H_x$.

Specifically, (A1) is selected from at least one alkali metal salt of a mixture of L- and D-enantiomers according to formula (I a), said mixture containing predominantly the respective L-isomer with an enantiomeric excess (ee) in the range of from 5 to 95%, preferably 10 to 75% and even more preferably 10 to 66%.

Alkali metals of GLDA are selected from compounds according to general formula (I b)

$$[OOC—CH_2CH_2—CH(COO)—N(CH_2—COO)_2]M_{4-x}H_x \quad \text{(I b)}$$

wherein

M is selected from alkali metal cations, same or different, as defined above, x in formula (I b) is in the range of from zero to 2.0, preferred are zero to 0.5. In a particularly preferred embodiment, x is zero.

Specifically, (A2) is selected from at least one alkali metal salt of a mixture of L- and D-enantiomers according to formula (I a), said mixture containing predominantly the respective L-isomer, for example in the range of from 50 to 99%, or from the racemic mixture.

In a preferred embodiment of the present invention, chelating agent (A) is selected from sodium and potassium salts of methylglycine diacetic acid and glutamic acid diacetic acid, in each case fully neutralized, with a weight ratio of (A1) and (A2) in the range of from 1:9 to 9:1.

In a preferred embodiment of the present invention, M is the same for (A1) and (A2).

In any way, minor amounts of chelating agent (A) may bear cations other than alkali metal. It is thus possible that minor amounts, such as 0.01 to 5 mol-% of total chelating agent (A) bear alkali earth metal cations such as $Mg^{2+}$ or $Ca^{2+}$, or an $Fe^{2+}$ or $Fe^{3+}$ cation.

The enantiomeric excess of MGDA and of its salts may be determined by measuring the polarization (polarimetry) or preferably by chromatography, for example by HPLC with a chiral column, for example with one or more cyclodextrins as immobilized phase or with a ligand exchange (Pirkle-brush) concept chiral stationary phase. Preferred is determination of the ee by HPLC with an immobilized optically active amine such as D-penicillamine in the presence of copper(II) salt. The enantiomeric excess of GLDA and of its salts may be determined by measuring the polarization (polarimetry).

In one embodiment of the present invention, alkali metal salts of chelating agent (A) may contain one or more impurities that may result from the synthesis of the respective chelating agents (A). In the cases of (A1) and (A2), such impurities may be propionic acid, lactic acid, alanine, nitrilotriacetic acid (NTA) or the like and their respective alkali metal salts. Such impurities are usually present in minor amounts. "Minor amounts" in this context refer to a total of 0.1 to 5% by weight, referring to alkali metal salt of chelating agent (A), preferably up to 2.5% by weight. In the context of the present invention, such minor amounts are neglected when determining the composition of granule made according to the inventive process.

In one embodiment of the present invention, the weight ratio of (A1) to (A2) or their respective salts in the mixture is in the range of from 1:9 to 9:1, preferably 1:3 to 3:1, more preferably 2:3 to 3:2.

In order to provide an aqueous solution containing (A1) and (A2), it is possible to mix an aqueous solution containing (A1) and an aqueous solution containing (A2), or to add solid (A1) to an aqueous solution containing (A2), or to add solid (A2) to an aqueous solution of (A1).

In a preferred embodiment of the present invention step (a) is performed by synthesizing (A1) and (A2) in a one-pot synthesis, for example by converting a mixture of L-alanine and alkali metal L-glutamate, especially sodium L-glutamate monohydrate or their respective partially neutralized alkali metal salts with formaldehyde and hydrocyanic acid or cyanide, followed by subsequent hydrolysis of the nitrile groups. Preferred embodiments of such one-pot syntheses shall be described in more detail below. For matters of simplicity, in the context of the present invention the conversion of a mixture of L-alanine and L-glutamic acid or their respective partially neutralized alkali metal salts with formaldehyde and hydrocyanic acid or cyanide shall also be referred to as step (a1), and the subsequent hydrolysis shall also be referred to as step (a2).

There are various ways to perform step (a1) of the inventive process. It is possible to prepare a solid mixture of alanine in its L- or D-enantiomeric form and alkali metal L-glutamate, especially sodium L-glutamate monohydrate as L- or D-enantiomer and to then dissolve the mixture so obtained in water. It is preferred, though, to slurry alanine and sodium glutamate in water and to then add the required amount of alkali metal hydroxide, as solid or as aqueous solution.

In one embodiment of the present invention, step (a1) of the inventive process is carried out at a temperature in the range of from 5 to 70° C., preferably in the range of from 15 to 60° C. During the performance of step (a), in many instances a raise of temperature can be observed, especially when the embodiment of slurring alanine and glutamic acid in water and to then add the required amount alkali metal hydroxide, as solid or as aqueous solution, has been chosen.

An aqueous solution of a mixture of alanine and its corresponding alkali metal salts and alkali metal L-glutamate monohydrate will be obtained.

Preferably, an aqueous solution of a mixture of alanine and its corresponding alkali metal salt and glutamic acid and its corresponding alkali metal salts may have a total solids content in the range of from 15 to 60%. Preferably, such aqueous solution of a mixture of alanine and its corresponding alkali metal salt and glutamic acid and its corresponding alkali metal salts may have a pH value in the range of from 6 to 12.

Preferably, such aqueous solution contains less than 0.5% by weight impurities, the percentage being based on the total solids content of the aqueous solution. Such potential impurities may be one or more of magnesium or calcium salts of inorganic acids. Trace amounts of impurities stemming from the L-alanine or the water used shall be neglected in the further context with the present invention.

Subsequently, a double Strecker synthesis is carried out by treating the above aqueous solution with formaldehyde and hydrocyanic acid or alkali metal cyanide. The double Strecker synthesis can be carried out by adding alkali metal cyanide or a mixture from hydrocyanic acid and alkali metal cyanide or preferably hydrocyanic acid and formaldehyde to the aqueous solution. Alternatively, the aqueous solution of the amino acids and/or their respective salts is first treated with formaldehyde to obtain the corresponding Schiff's base followed by addition of hydrocyanic acid. Said addition of formaldehyde and alkali metal cyanide or preferably hydrocyanic acid can be performed in one or more portions. Formaldehyde can be added as gas or as formalin solution or as paraformaldehyde. Preferred is the addition of formaldehyde as 30 to 35% by weight aqueous solution.

In a particular embodiment of the present invention, step (a1) is carried out at a temperature in the range of from 5 to 80° C., preferably from 10 to 45° C.

In one embodiment of the present invention, step (a1) is carried out at a constant temperature in the above range. In another embodiment, step (a1) is carried out using a temperature profile, for example by starting the reaction at 15° C. and allowing then stirring the reaction mixture at 25° C.

In one embodiment of the present invention, step (a1) is carried out at elevated pressure, for example 1.01 to 6 bar. In another embodiment, step (a1) is carried out at normal pressure (1 bar).

In one embodiment of the present invention, step (a1) is carried out at a constant pH value, and a base or an acid is added in order to keep the pH value constant. Preferably, however, the pH value during step (a1) is decreasing, and neither base nor acid other than, optionally, HCN is added. In such embodiments, at the end of step (a1), the pH value may have dropped to 2 to 4.

In one embodiment of the present invention, step (a1) is carried out by adding 1.9 to 2.5 equivalents based on moles of amine groups of HCN, preferably 1.9 to 2.3, more preferably 1.95 to 2.1.

In one embodiment of the present invention, step (a1) is out by adding 1.9 to 2.5 equivalents based on moles of amine groups of formaldehyde, preferably 1.9 to 2.3, more preferably 1.95 to 2.1.

Step (a1) can be performed in any type of reaction vessel that allows the handling of hydrocyanic acid. Useful are, for example, flasks, stirred tank reactors and cascades of two or more stirred tank reactors.

From step (a1), an aqueous solution of the L- and/or D-enantiomer of the following two dinitriles of formula (B1) and formula (B2) and their corresponding alkali metal salts are obtained, briefly also referred to as dinitriles (B1) and (B2) or alkali metal salt of dinitrile (B1) and (B2), respectively.

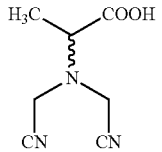

(B1)

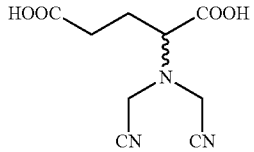

(B2)

In a preferred embodiment of step (a2), the dinitriles resulting from step (a1) are hydrolysed, preferably saponified in two steps (a2.1) and (a2.2), at different temperatures. In another preferred embodiment stoichiometric amounts of hydroxide or an excess of 1.01 to 1.5 moles of hydroxide per molar sum of COOH groups and nitrile groups of dinitrile of step (a1), preferably 1.01 to 1.2 moles, are employed.

Different temperature means in the context of step (a2) that the average temperature of step (a2.1) is different from the average temperature of step (a2.2). Preferably, step (a2.1) is performed at a temperature lower than step (a2.2). Even more preferably, step (a2.2) is performed at an average temperature that is at least 80 K higher than the average temperature of step (a2.1). Hydroxide in the context of step (a2) refers to alkali metal hydroxide, preferably potassium hydroxide or combinations of sodium hydroxide and potassium hydroxide and even more preferably to sodium hydroxide.

Step (a2.1) can be started by adding the solution resulting from step (a.1) to an aqueous solution of alkali metal hydroxide or adding an aqueous solution of alkali metal hydroxide to a solution resulting from step (a.1). In another embodiment, the solution resulting from step (a.1) and an aqueous solution of alkali metal hydroxide are added simultaneously to a vessel.

When calculating the stoichiometric amounts of hydroxide to be added in step (a.2), the sum of COOH groups and nitrile groups from the total theoretical amount of dinitriles (B1) and (B2) is calculated and the amounts of alkali already present from the at least partial neutralization of amino acids before the dinitrile formation and, optionally, step (a.1), is subtracted.

Step (a2.1) can be performed at a temperature in the range of from 10 to 80° C., preferable 30 to 65° C. In the context of step (a2.1) "temperature" refers to the average temperature.

As a result of step (a2.1), an aqueous solution of the respective diamides and their respective alkali metal salts can be obtained, M being alkali metal. Said solution may also contain corresponding monoamides and/or its mono-, di-, or tri-alkali metal salt.

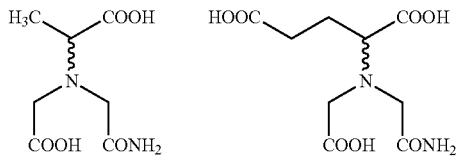

Step (a2.2) can be performed at a temperature in the range of from 90 to 195° C., preferably 175 to 195° C. In the context of step (a2.2) "temperature" refers to the average temperature.

In one embodiment of the present invention, step (a2.2) has an average residence time in the range of from 15 to 360 minutes.

In preferred embodiments the higher range of the temperature interval of step (a2.2) such as 190 to 195° C. is combined with a short residence time such as 15 to 25 minutes, or the lower range of the temperature interval of step (a2.2) such as 90° C. to 110° C. is combined with a longer residence time such as 200 to 360 minutes, or a middle temperature such as 185° C. is combined with a middle residence time such as 20 to 45 minutes.

Step (a2.2) can be performed in the same reactor as step (a2.1), or—in the case of a continuous process—in a different reactor.

In one embodiment of the present invention step (a2.2) is carried out with an excess of base of 1.01 to 1.2 moles of hydroxide per mole of nitrile group.

Depending on the type of reactor in which step (a2.2) is performed, such as an ideal plug flow reactor, the average residence time can be replaced by the residence time.

In one embodiment of the present invention, step (a2.1) is carried out in a continuous stirred tank reactor and step (a2.2) is carried out in a second continuous stirred tank reactor. In a preferred embodiment, step (a2.1) is carried out in a continuous stirred tank reactor and step (a2.2) is carried out in a plug flow reactor, such as a tubular reactor.

In one embodiment of the present invention, step (a2.1) of the inventive process is carried out at elevated pressure, for example at 1.05 to 6 bar. In another embodiment, step (a2.1) of the inventive process is carried at normal pressure.

Especially in embodiments wherein step (a2.2) is carried out in a plug flow reactor, step (a2.2) may be carried out at elevated pressure such as 1.5 to 40 bar, preferably at least 20 bar. The elevated pressure may be accomplished with the help of a pump or by autogenic pressure elevation.

Preferably, the pressure conditions of steps (a2.1) and (a2.2) are combined in the way that step (a2.2) is carried out at a higher pressure than step (a2.1).

During step (a2.2), a partial racemization takes place. Without wishing to be bound by any theory, it is likely that racemization takes place on the stage of the above L-diamides or of L-MGDA resp. L-GLDA.

In one embodiment of the present invention, the inventive process may comprise steps other than the steps (a1) and (a2) disclosed above. Such additional steps may be, for example, one or more decolourization steps, for example with activated carbon or with peroxide such as $H_2O_2$, or by UV irradiation or combinations of at least two of the foregoing.

An aqueous solution is obtained that contains (A1) at least one alkali metal salt of a mixture of L- and D-enantiomers of methyl glycine diacetic acid (MGDA), said mixture containing predominantly the respective L-isomer with an enantiomeric excess (ee) in the range of from 10 to 95%, and (A2) at least one alkali metal salt of L- and D-enantiomers of glutamic acid diacetic acid (GLDA) or of enantiomerically pure L-GLDA, the weight ratio of (A1) and (A2) being in the range of from 1:9 to 9:1.

In an—optional—intermediary step, said solution may be concentrated to yield a slurry. It is preferred, though, to start step (b) with an aqueous solution.

In step (b) of the inventive process, the slurry or—preferably—the aqueous solution obtained from step (a) is spray granulated with a gas inlet temperature of at least 125° C.

Spray-granulation may be performed in a fluidized bed or a spouted bed.

A spouted bed is usually achieved in a jet apparatus, a gaseous driving jet is positioned centrally in a chamber, said driving jet being directed from bottom upwards, or two or more gaseous driving jets are positioned in the region of the center of the chamber and being directed from bottom upwards. Solution is sprayed into the chamber. The gaseous driving jet(s) create a loop motion of the granule so formed, by creating a loop zone and a return zone.

Spray-granulation may be performed by performing two or more consecutive spray-drying processes, for example in a cascade of at least two spray dryers, for example in a cascade of at least two consecutive spray towers or a combination of a spray tower and a spray chamber, said spray chamber containing a fluidized bed. In other embodiments, only one spray granulating step is performed.

Spray granulating in a fluidized bed is performed through one or more nozzles per spray tower or spray granulator. Suitable nozzles are, for example, high-pressure rotary drum atomizers, rotary atomizers, three-fluid nozzles, single-fluid nozzles and two-fluid nozzles, single-fluid nozzles and two-fluid nozzles being preferred. The first fluid is the aqueous solution from step (a), the second fluid is compressed gas, also referred to as nozzle gas or atomizing gas, for example with a pressure of 1.1 to 7 bar absolute. The nozzle gas may have a temperature in the range of from 20 to 250° C., preferably 20 to 100° C. The nozzle gas is, for example, nitrogen or air, and by spraying the solution or slurry is converted into droplets and the water is vaporized. The fluidized bed is fluidized with the help of fluidization gas, also referred to as drying gas.

Suitable as fluidization gas is air, nitrogen, or nitrogen-enriched air. The fluidization gas may have a temperature in the range of from 125 to 250° C., preferably 160 to 220° C. and a pressure of from 0.9 to 1.1 bar, abs, for example 1 mbar less than ambient pressure.

In embodiments wherein a cascade of at least two spray dryers. In the first spray dryer, a solid, for example a powder, is made. The second spray dryer is charged with a fluidized bed with solid from the first spray dryer, and aqueous solution obtained according to step (a) is sprayed onto or into the fluidized bed, together with a hot gas inlet stream. The hot gas inlet stream may have a temperature in the range of from 125 to 350° C., preferably 160 to 220° C.

In a spouted bed, fluidization of the bed of granules is achieved by a jet stream of drying gas. Said jet stream is introduced from the bottom of the apparatus in which the spouted bed is established.

In embodiments wherein an aged solution is used, such aging may take in the range of from 2 hours to 24 hours at the temperature preferably higher than ambient temperature.

In the course of step (b), most of the water of the aqueous solution provided in step (a) is removed. Most of the water shall mean that a residual moisture content preferably of 5 to 15% by weight, referring to the granule, remains. Preferably, about 51 to 75% by weight of the water present in the aqueous solution is removed in step (b).

In some embodiments of the present invention, the inventive process may comprise one or more additional steps. Such additional step(s) may be performed between step (a) and step (b) or during step (b) or after step (b). Examples of such additional steps are sieving and post-drying steps, sometimes also referred to as thermal after-treatment, preferably after step (b). Thermal after-treatment may be performed in a drying oven, for example at a temperature in the range from 80 to 120° C., or with hot steam, preferably at 100 to 160° C. Other—optional—steps are pre-concentration steps between step (a) and step (b).

Examples of additional optional steps during step (b) are removal of fines, removal of particles that are too big, so called "overs", recycling of fines, and milling down and recycling of such milled down overs.

For example, fines may be defined as particles with a maximum diameter of 150 μm or less and generated during step (b), for example 1 to 150 μm. So-called overs or lumps may have a minimum diameter of 1 mm or more, for example 1 mm up to 5 mm. Such lumps may be removed from the spray granulator and milled down to a maximum particle diameter of 500 μm, preferably to a maximum particle diameter of 400 μm. The milling may be performed in any type of mills. Examples of particularly useful mills are jet mills, pin mills and bolting machines (German: Stiftmühlen). Further examples are roller mills and ball mills. After that, the fines and the milled down lumps are returned into the spray granulator.

In one embodiment of the present invention, a share of 1 to 15% of fines and 1 to 40% of milled down lumps are returned into the granulator, percentages referring to the overall granule.

By performing the inventive process, granules are obtained that exhibit excellent performance properties, especially with respect to yellowing, for example to percarbonate stability and tablet stability.

A further aspect of the present invention is related to a granule with a residual moisture content in the range of from 5 to 15% by weight, containing (A1) at least one alkali metal salt of a mixture of L- and D-enantiomers of methyl glycine diacetic acid (MGDA), said mixture containing predominantly the respective L-isomer with an enantiomeric excess (ee) in the range of from 5 to 95%, (A2) at least one alkali metal salt of L- and D-enantiomers of glutamic acid diacetic acid (GLDA) or of enantiomerically pure L-GLDA, in molecular disperse form, the weight ratio of (A1) and (A2) being in the range of from 1:9 to 9:1. Moles refer to the anions.

(A1) and (A2) have been explained in detail above.

Inventive granules have a residual moisture content in the range of from 5 to 15% by weight, preferably 6 to 10. The residual moisture content may be determined by Karl-Fischer titration or by drying at 160° C. to constant weight with infrared light.

In one embodiment of the present invention, inventive granule has an average particle diameter in the range of from 0.35 mm to 1.5 mm, preferably from 350 to 1,000 μm, even more preferably up to 900 μm. The highest number of particles preferably has an average particle diameter in the range of from 600 to 750 μm.

Another aspect of the present invention relates to the use of inventive granules, and another aspect of the present invention relates to methods of use inventive granules. The preferred use of inventive granules is for the manufacture of solid laundry detergent compositions and of solid detergent compositions for hard surface cleaning. Solid laundry detergent compositions and solid detergent compositions for hard surface cleaning may contain some residual moisture, for example 0.1 to 10% by weight, but are otherwise solid mixtures. The residual moisture content may be determined, e.g., under vacuum at 80° C. Another aspect of the present invention relates to solid laundry detergent compositions and to solid detergent compositions for hard surface cleaning.

In the context of the present invention, the term "detergent composition for cleaners" includes cleaners for home care and for industrial or institutional applications. The term "detergent composition for hard surface cleaners" includes compositions for dishwashing, especially hand dishwash and automatic dishwashing and ware-washing, and compositions for other hard surface cleaning such as, but not limited to compositions for bathroom cleaning, kitchen cleaning, floor cleaning, descaling of pipes, window cleaning, car cleaning including truck cleaning, furthermore, open plant cleaning, cleaning-in-place, metal cleaning, disinfectant cleaning, farm cleaning, high pressure cleaning, but not laundry detergent compositions.

In the context of the present invention and unless expressly stated otherwise, percentages in the context of ingredients of laundry detergent compositions are percentages by weight and refer to the total solids content of the respective laundry detergent composition. In the context of the present invention and unless expressly stated otherwise, percentages in the context of ingredients of detergent composition for hard surface cleaning are percentages by weight and refer to the total solids content of the detergent composition for hard surface cleaner.

In one embodiment of the present invention, solid laundry detergent compositions according to the present invention may contain in the range of from 1 to 30% by weight of inventive granule. Percentages refer to the total solids content of the respective laundry detergent composition.

In one embodiment of the present invention, inventive solid detergent compositions for hard surface cleaning may contain in the range of from 1 to 50% by weight of inventive granule, preferably 5 to 40% by weight and even more preferably 10 to 25% by weight. Percentages refer to the total solids content of the respective detergent composition for hard surface cleaning.

Particularly advantageous inventive solid detergent compositions for hard surface cleaning and inventive solid laundry detergent compositions, especially for home care, contain one or more complexing agent other than inventive granule. Inventive solid detergent compositions for hard surface cleaning and inventive solid laundry detergent compositions may contain one or more complexing agent (in the context of the present invention also referred to as sequestrant) other than an inventive granule. Examples are citrate, phosphonic acid derivatives, for example the disodium salt of hydroxyethane-1,1-diphosphonic acid ("HEDP"), and polymers with complexing groups like, for example, polyethylenimine in which 20 to 90 mole-% of the N-atoms bear at least one $CH_2COO^-$ group, and their respective alkali metal salts, especially their sodium salts, for IDS-$Na_4$, and trisodium citrate, and phosphates such as STPP (sodium tripolyphosphate). Due to the fact that phosphates raise environmental concerns, it is preferred that advantageous detergent compositions for cleaners and advantageous laundry detergent compositions are free from phosphate. "Free from phosphate" should be understood in the context of the present invention, as meaning that the content of phosphate and polyphosphate is in sum in the range from 10 ppm to 0.2% by weight, determined by gravimetric analysis.

Preferred inventive solid detergent compositions for hard surface cleaning and preferred inventive solid laundry detergent compositions may contain one or more surfactant, preferably one or more non-ionic surfactant.

Preferred non-ionic surfactants are alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

(III)

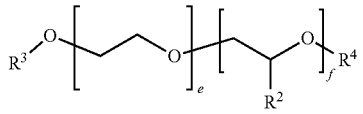

in which the variables are defined as follows:

$R^2$ is identical or different and selected from hydrogen and linear $C_1$-$C_{10}$-alkyl, preferably in each case identical and ethyl and particularly preferably hydrogen or methyl, $R^3$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^4$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, The variables e and f are in the range from zero to 300, where the sum of e and f is at least one, preferably in the range of from 3 to 50. Even more preferably, e is in the range from 1 to 100 and f is in the range from 0 to 30.

In one embodiment, compounds of the general formula (III) may be block copolymers or random copolymers, preference being given to block copolymers.

Other preferred examples of alkoxylated alcohols are, for example, compounds of the general formula (IV)

(IV)

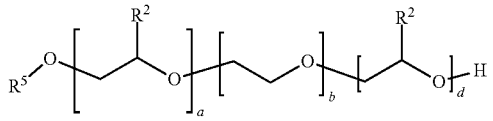

in which the variables are defined as follows:

$R^2$ is identical or different and selected from hydrogen and linear $C_1$-$C_0$-alkyl, preferably identical in each case and ethyl and particularly preferably hydrogen or methyl, $R^5$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Preferred examples of hydroxyalkyl mixed ethers are compounds of the general formula (V)

(V)

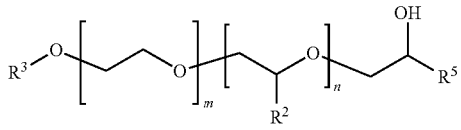

in which the variables are defined as follows:

$R^2$ is identical or different and selected from hydrogen and linear $C_1$-$C_{10}$-alkyl, preferably in each case identical and ethyl and particularly preferably hydrogen or methyl, $R^3$ is selected from $C_8$-$C_{22}$-alkyl, branched or linear, for example iso-$C_{11}H_{23}$, iso-$C_{13}H_{27}$, n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^5$ is selected from $C_6$-$C_{20}$-alkyl, for example n-hexyl, isohexyl, sec-hexyl, n-heptyl, n-octyl, 2-ethylhexyl, n-nonyl, n-decyl, isodecyl, n-dodecyl, n-tetradecyl, n-hexadecyl, and n-octadecyl.

The variables m and n are in the range from zero to 300, where the sum of n and m is at least one, preferably in the range of from 5 to 50. Preferably, m is in the range from 1 to 100 and n is in the range from 0 to 30.

Compounds of the general formula (IV) and (V) may be block copolymers or random copolymers, preference being given to block copolymers.

Further suitable non-ionic surfactants are selected from di- and multiblock copolymers, composed of ethylene oxide and propylene oxide. Further suitable non-ionic surfactants are from ethoxylated or propoxylated sorbitan esters. Amine oxides or alkyl polyglycosides, linear $C_4$-$C_{16}$-alkyl polyglucosides and branched $C_8$-$C_{14}$-alkyl polyglycosides such as compounds of general average formula (VI) are likewise suitable.

(VI)

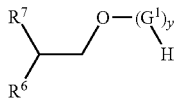

wherein:

$R^6$ is $C_1$-$C_4$-alkyl, in particular ethyl, n-propyl or isopropyl, $R^7$ is —$(CH_2)_2$—$R^6$, $G^1$ is selected from monosaccharides with 4 to 6 carbon atoms, especially from glucose and xylose, y in the range of from 1.1 to 4, y being an average number, Further examples of non-ionic surfactants are compounds of general formula (VII) and (VIII)

(VII)

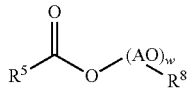

(VIII)

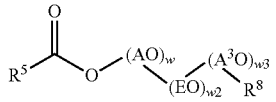

AO is selected from ethylene oxide, propylene oxide and butylene oxide,

EO is ethylene oxide, $CH_2CH_2$—O, $R^8$ selected from $C_8$-$C_{18}$-alkyl, branched or linear, and $R^5$ is defined as above.

$A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

An overview of suitable further non-ionic surfactants can be found in EP-A 0 851 023 and in DE-A 198 19 187.

Mixtures of two or more different non-ionic surfactants selected from the foregoing may also be present.

Other surfactants that may be present are selected from amphoteric (zwitterionic) surfactants and anionic surfactants and mixtures thereof.

Examples of amphoteric surfactants are those that bear a positive and a negative charge in the same molecule under use conditions. Preferred examples of amphoteric surfactants are so-called betaine-surfactants. Many examples of betaine-surfactants bear one quaternized nitrogen atom and one carboxylic acid group per molecule. A particularly preferred example of amphoteric surfactants is cocamidopropyl betaine (lauramidopropyl betaine).

Examples of amine oxide surfactants are compounds of the general formula (IX)

$$R^9R^{10}R^{11}N\rightarrow O \quad (IX)$$

wherein $R^9$, $R^{10}$, and $R^{11}$ are selected independently from each other from aliphatic, cycloaliphatic or $C_2$-$C_4$-alkylene $C_{10}$-$C_{20}$-alkylamido moieties. Preferably, $R^9$ is selected from $C_8$-$C_{20}$-alkyl or $C_2$-$C_4$-alkylene $C_{10}$-$C_{20}$-alkylamido and $R^{10}$ and $R^{11}$ are both methyl.

A particularly preferred example is lauryl dimethyl aminoxide, sometimes also called lauramine oxide. A further particularly preferred example is cocamidylpropyl dimethylaminoxide, sometimes also called cocamidopropylamine oxide.

Examples of suitable anionic surfactants are alkali metal and ammonium salts of $C_8$-$C_{18}$-alkyl sulfates, of $C_8$-$C_{18}$-fatty alcohol polyether sulfates, of sulfuric acid half-esters of ethoxylated $C_4$-$C_{12}$-alkylphenols (ethoxylation: 1 to 50 mol of ethylene oxide/mol), $C_{12}$-$C_{18}$ sulfo fatty acid alkyl esters, for example of $C_{12}$-$C_{18}$ sulfo fatty acid methyl esters, furthermore of $C_{12}$-$C_{18}$-alkylsulfonic acids and of $C_{10}$-$C_{18}$-alkylarylsulfonic acids. Preference is given to the alkali metal salts of the aforementioned compounds, particularly preferably the sodium salts.

Further examples for suitable anionic surfactants are soaps, for example the sodium or potassium salts of stearic acid, oleic acid, palmitic acid, ether carboxylates, and alkylether phosphates.

Preferably, inventive laundry detergent compositions contain at least one anionic surfactant.

In one embodiment of the present invention, inventive solid laundry detergent compositions may contain 0.1 to 60% by weight of at least one surfactant, selected from anionic surfactants, amphoteric surfactants and amine oxide surfactants.

In one embodiment of the present invention, inventive solid detergent compositions for cleaners may contain 0.1 to 60% by weight of at least one surfactant, selected from anionic surfactants, amphoteric surfactants and amine oxide surfactants.

In a preferred embodiment, inventive solid detergent compositions for cleaners and especially those for automatic dishwashing do not contain any anionic surfactant.

Inventive solid detergent compositions for hard surface cleaning and inventive solid laundry detergent compositions may contain at least one bleaching agent, also referred to as bleach. Bleaching agents may be selected from chlorine bleach and peroxide bleach, and peroxide bleach may be selected from inorganic peroxide bleach and organic peroxide bleach. Preferred are inorganic peroxide bleaches, selected from alkali metal percarbonate, alkali metal perborate and alkali metal persulfate.

Examples of organic peroxide bleaches are organic percarboxylic acids, especially organic percarboxylic acids.

In inventive solid detergent compositions for hard surface cleaning and in inventive solid laundry detergent compositions, alkali metal percarbonates, especially sodium percarbonates, are preferably used in coated form. Such coatings may be of organic or inorganic nature. Examples are glycerol, sodium sulfate, silicate, sodium carbonate, and combinations of at least two of the foregoing, for example combinations of sodium carbonate and sodium sulfate.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Inventive solid detergent compositions for hard surface cleaning and inventive solid laundry detergent compositions may comprise, for example, in the range from 3 to 10% by weight of chlorine-containing bleach.

Inventive solid detergent compositions for hard surface cleaning and inventive solid laundry detergent compositions may comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Inventive solid detergent compositions for hard surface cleaning and inventive solid laundry detergent compositions may comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Inventive solid detergent compositions for hard surface cleaning and inventive solid laundry detergent compositions may comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, inventive solid detergent compositions for hard surface cleaning and inventive solid laundry detergent compositions comprise in total in the range from 0.1 to 1.5% by weight of corrosion inhibitor.

Inventive solid detergent compositions for hard surface cleaning and inventive solid laundry detergent compositions may comprise one or more builders, selected from organic and inorganic builders. Examples of suitable inorganic builders are sodium sulfate or sodium carbonate or silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

Examples of organic builders are especially polymers and copolymers. In one embodiment of the present invention, organic builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid, and in the same range of molecular weight.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilic or hydrophobic monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also non-ionic monomers with hydroxyl function or alkylene oxide groups. By way of example, mention may be made of: allyl alcohol, isoprenol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly(propylene oxide-co-ethylene oxide) (meth) acrylate. Polyalkylene glycols here may comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

A further example of builders is carboxymethyl inulin.

Moreover, amphoteric polymers can also be used as builders.

Inventive solid detergent compositions for hard surface cleaning and inventive solid laundry detergent compositions may comprise, for example, in the range from in total 10 to 70% by weight, preferably up to 50% by weight, of builder. In the context of the present invention, (A1) and (A2) are not counted as builder.

In one embodiment of the present invention, inventive solid detergent compositions for hard surface cleaning and inventive solid laundry detergent compositions may comprise one or more cobuilders.

Inventive solid detergent compositions for hard surface cleaning and inventive solid laundry detergent compositions may comprise one or more antifoams, selected for example from silicone oils and paraffin oils.

In one embodiment of the present invention, inventive solid detergent compositions for hard surface cleaning and inventive solid laundry detergent compositions comprise in total in the range from 0.05 to 0.5% by weight of antifoam.

Inventive solid detergent compositions for hard surface cleaning and inventive solid laundry detergent compositions may comprise one or more enzymes. Examples of enzymes are lipases, hydrolases, amylases, proteases, cellulases, esterases, pectinases, lactases and peroxidases.

In one embodiment of the present invention, inventive solid detergent compositions for hard surface cleaning and inventive solid laundry detergent compositions may comprise, for example, up to 5% by weight of enzyme, preference being given to 0.1 to 3% by weight. Said enzyme may be stabilized, for example with the sodium salt of at least one $C_1$-$C_3$-carboxylic acid or $C_4$-$C_{10}$-dicarboxylic acid. Preferred are formates, acetates, adipates, and succinates.

In one embodiment of the present invention, inventive solid detergent compositions for hard surface cleaning and inventive solid laundry detergent compositions comprise at least one zinc salt. Zinc salts can be selected from water-soluble and water-insoluble zinc salts. In this connection, within the context of the present invention, water-insoluble is used to refer to those zinc salts which, in distilled water at 25° C., have a solubility of 0.1 g/l or less. Zinc salts which have a higher solubility in water are accordingly referred to within the context of the present invention as water-soluble zinc salts.

In one embodiment of the present invention, zinc salt is selected from zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate, preferably $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt is selected from ZnO, ZnO.aq, $Zn(OH)_2$ and $ZnCO_3$. Preference is given to ZnO.aq.

In one embodiment of the present invention, zinc salt is selected from zinc oxides with an average particle diameter (weight-average) in the range from 10 nm to 100 μm.

The cation in zinc salt can be present in complexed form, for example complexed with ammonia ligands or water ligands, and in particular be present in hydrated form. To simplify the notation, within the context of the present invention, ligands are generally omitted if they are water ligands.

Depending on how the pH of mixture according to the invention is adjusted, zinc salt can change. Thus, it is for example possible to use zinc acetate or $ZnCl_2$ for preparing formulation according to the invention, but this converts at a pH of 8 or 9 in an aqueous environment to ZnO, $Zn(OH)_2$ or ZnO.aq, which can be present in non-complexed or in complexed form.

Zinc salt may be present in those detergent compositions for cleaners according to the invention which are solid at room temperature are preferably present in the form of particles which have for example an average diameter (number-average) in the range from 10 nm to 100 μm, preferably 100 nm to 5 μm, determined for example by X-ray scattering.

Zinc salt may be present in those detergent compositions for home which are liquid at room temperature in dissolved or in solid or in colloidal form.

In one embodiment of the present invention, detergent compositions for cleaners and laundry detergent compositions comprise in total in the range from 0.05 to 0.4% by weight of zinc salt, based in each case on the solids content of the composition in question.

Here, the fraction of zinc salt is given as zinc or zinc ions. From this, it is possible to calculate the counterion fraction.

In one embodiment of the present invention, inventive solid detergent compositions for hard surface cleaning and inventive solid laundry detergent compositions are free from heavy metals apart from zinc compounds. Within the context of the present, this may be understood as meaning that detergent compositions for cleaners and laundry detergent compositions according to the invention are free from those heavy metal compounds which do not act as bleach catalysts, in particular of compounds of iron and of bismuth. Within the context of the present invention, "free from" in connection with heavy metal compounds is to be understood as meaning that the content of heavy metal compounds which do not act as bleach catalysts is in sum in the range from 0 to 100 ppm, determined by the leach method and based on the solids content. Preferably, formulation according to the invention has, apart from zinc, a heavy metal content below 0.05 ppm, based on the solids content of the formulation in question. The fraction of zinc is thus not included.

Within the context of the present invention, "heavy metals" are defined to be any metal with a specific density of at least 6 g/cm$^3$ with the exception of zinc. In particular, the heavy metals are metals such as bismuth, iron, copper, lead, tin, nickel, cadmium and chromium.

Preferably, inventive solid detergent compositions for hard surface cleaning and inventive solid laundry detergent compositions comprise no measurable fractions of bismuth compounds, i.e. for example less than 1 ppm.

In one embodiment of the present invention, inventive solid detergent compositions for hard surface cleaning and inventive solid laundry detergent compositions comprise one or more further ingredient such as fragrances, dyestuffs, organic solvents, buffers, disintegrants for tablets ("tabs"), and/or acids such as methylsulfonic acid.

Preferred example detergent compositions for automatic dishwashing may be selected according to table 1.

TABLE 1

Example detergent compositions for automatic dishwashing

| All amounts in g/sample | ADW.1 | ADW.2 | ADW.3 |
|---|---|---|---|
| granule, 50 wt. % MGDA-$Na_3$, ee: 50%, and 50 wt % L-GLDA-$Na_4$ | 30 | 22.5 | 15 |
| Protease | 2.5 | 2.5 | 2.5 |
| Amylase | 1 | 1 | 1 |
| n-$C_{18}H_{37}$—$O(CH_2CH_2O)_9H$ | 5 | 5 | 5 |
| Polyacrylic acid $M_w$ 4000 g/mol as sodium salt, completely neutralized | 10 | 10 | 10 |
| Sodium percarbonate | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate | 15 | 22.5 | 30 |
| HEDP | 0.5 | 0.5 | 0.5 |
| ethoxylated polyethylenimine, 20 EO/NH group, $M_n$: 30,000 g/mol | optionally: 0.1 | optionally: 0.1 | optionally: 0.1 |

Laundry detergent compositions according to the invention are useful for laundering any type of laundry, and any type of fibres. Fibres can be of natural or synthetic origin, or they can be mixtures of natural of natural and synthetic fibres. Examples of fibers of natural origin are cotton and wool. Examples for fibers of synthetic origin are polyurethane fibers such as Spandex® or Lycra®, polyester fibers, or polyamide fibers. Fibers may be single fibers or parts of textiles such as knitwear, fabrics, or nonwovens.

Another aspect of the present invention is a process for making tablets for automatic dishwashing from a granule, wherein said granule is selected from granules according to the present invention. said process is hereinafter also referred to as pelletizing process according to the invention. During making such tablets, only a low percentage of breakage is observed, and storage stability of such tablets, hereinafter also referred to as inventive tablets, is excellent.

Inventive tablets are preferably made with the help of a machine, for example a tablet press.

The pelletizing process according to the invention can be carried out by mixing granule according to the invention with at least one non-ionic surfactant and optionally one or more further substance and then compressing the mixture to give tablets. Examples of suitable non-ionic surfactants and further surfactants such as builders, enzymes are listed above. Particularly preferred examples of non-ionic surfactants are hydroxy mixed ethers, for example hydroxy mixed ethers of the general formula (V).

The pelletizing process according to the invention can be carried out as a direct pelletizing process, i.e. without pelletizing auxiliaries, or with the help of one or more pelletizing auxiliaries. It is preferred to carry out the pelletizing process according to the invention in spaces which have a suitably low relative atmospheric humidity, for example up to 50%.

The pelletizing process according to the invention can be carried out at room temperature under conditions with or without conditioned air, in the case of which atmospheric humidity and/or temperature are kept constant. Under these conditions, it is advantageous for the pelletizing instrument to be encapsulated or isolated in some other way from the surroundings. These conditions can be necessary or advantageous for example in the event of high atmospheric humidity of the outside air or high hygroscopicity of individual components.

The pelletizing process according to the invention is preferably carried out using a pelletizing press. Small numbers of tablets can be produced with the help of a manually operated pelletizing press. Embodiments of pelletizing presses suitable for large numbers are rotary pelletizing presses, roller pelletizing presses and eccentric presses. Preferably, dishwashing detergent according to the invention is firstly portioned and then compressed. During the compression, a compression force is used; compression forces in the range from 50 to 500 MPa are suitable.

After the pelletizing, the tablets are removed from the pelletizing press. In an optional step, the freshly produced tablets can also be coated or packaged.

Tablets produced according to the invention have only a slight tendency toward tablet flaws such as sticking or capping. The term "sticking" is generally understood as meaning the sticking of the tablet mass to the compression surfaces of the punch and not the bonding of the tablet with the wall of the die, i.e. the adhesion outweighs the cohesion. In the case of capping, a convexly curved cover layer becomes detached at the breakage site following compression still in the die and/or after or during ejection of the compact. It is even possible for the entire tablet to cleave in the form of layers. Causes contemplated for the capping are the radial pressures acting on the tablet as a result of the compression die, an inhomogeneous porosity distribution and residual stresses in the tablet, and the elastic relaxation of the particles and of the entire tablet upon ejection. By contrast, tablets produced according to the invention are more stable to impacts but dissolve rapidly in water.

The invention is further illustrated by working examples.

General Remarks:

The hygroscopicity was determined by storing at 25° C. and 50% relative humidity over a period of 24 hours. In the alternative, so-called tropic conditions are storing at 35° C. and 70 to 90% relative humidity over a period of 24 hours. Grade: from zero (free flowing granule/powder) to 4 (granule/powder has dissolved)

With exception of ee values, percentages in the context of the examples refer to percent by weight unless expressly indicated otherwise.

The ee values of MGDA were determined by HPLC using a Chirex 3126 column; (D)-penicillamine, 5 μm, 250×4.6 mm. The mobile phase (eluent) was 0.5 mM aqueous $CuSO_4$-solution. Injection: 10 μl, flow: 1.5 ml/min. Detection by UV light at 254 nm. Temperature: 20° C. Running time was 25 min. The ee value was determined as difference of the area % of the Land D-MGDA peak divided by the sum of area % of L- and D-MGDA peak. Sample preparation: A 10 ml measuring flask was charged with 5 mg of test material and then filled mark with the eluent and then homogenized.

GLDA: the ee value was determined by measuring the rotational value.

Specific rotation may be determined at 20° C., wavelength 589 nm, with a modular circular polarimeter MCP 300, Fa. Anton Paar GmbH.

Average particle diameters are (D50) values and are determined by sieving methods unless expressly noted otherwise.

I. Synthesis of a Solution of MGDA-$Na_3$ and GLDA-$Na_4$ with 30% Ee

I.1 Providing a Partially Neutralized Solution of L-Alanine and L-Glutamate

In a stirred reactor, 400.9 g (4.46 mol) L-alanine, 234.0 g (2.93 mol) sodium hydroxide as 50% solution in water and 832.2 g water were mixed at 70° C. Then, 665.2 g (3.55 mol) sodium L-glutamate monohydrate were added. The mixture was stirred at 60-70° C. until it was completely clear.

I.2 Step: (c1-1) Strecker Reaction (Nitrile Synthesis)

The above described feed solution was used for the Strecker synthesis, which was conducted in a cascade of three stirred tank reactors.

The partially neutralized feed solution, formaldehyde as 30% aqueous solution, and HCN (80% of total amount) were added to a stirred reactor at 20° C. In a second stirred reactor additional HCN (20% of total amount) was added at 20° C. In a third stirred reactor at 20° C., the reaction was completed.

The reaction mixture obtained under steady state conditions was used as feed for the cold saponification.

I.3 Saponification (c2.1-1) Cold Saponification:

The cold saponification was conducted in a cascade of two stirred tank reactors and a tubular reactor. The temperature was approximately 55° C. in all reactors.

In a first stirred reactor, the feed solution and NaOH as 50% aqueous solution were added. For completion of the reaction, the mixture was further reacted in a second stirred tank reactor and in a tubular reactor.

The solution obtained under steady state conditions was used as feed in the hot saponification.

(c2.2-1) Hot Saponification:

The hot saponification was performed at 180° C. and 24 bar in a tubular plug flow reactor at 30 min retention time. The solution obtained under steady state conditions was treated in a stirred reactor at 970 mbar at 97° C. Then it is stripped in a wiped film evaporator at 110° C. and 900 mbar to further evaporate ammonia. Then, the concentration of total complexing agent (A.1) was adjusted to approximately 40 wt % (based on iron binding capacity).

The molar ratio of the feed materials was as follows:

L-alanine: 0.56

Sodium L-glutamate monohydrate: 0.44

Sodium hydroxide used for partial neutralization: 0.36

Formaldehyde: 1.97

HCN: 1.99

NaOH (sum of partial neutralization and NaOH added in cold saponification): 3.04

The mixture contained 20.7 wt % GLDA-$Na_4$ and 19.9 wt % MGDA-$Na_3$. The enantiomeric excess of L-MGDA-$Na_3$ was 30% ee, the same for L-GLDA-$Na_4$.

II. Manufacture of a Mixture of MGDA-$Na_3$ (Ee=37%) and GLDA-$Na_4$ (Ee=95%), (A1.2) to (A2.2)

A mixture of 8,941 g MGDA-$Na_3$ (39.6% by weight aqueous solution, ee=35%, rotational value=0.76) and 9,010 g GLDA-$Na_4$ (39.4% by weight aqueous solution, ee=95%, rotational value=2.74) was manufactured by mixing respective solutions. The resulting solution was a mixture MGDA/GLDA 1:1 (39.5% by weight aqueous solution, overall rotational value=1.75).

III. Spray Granulation in a Spouted Bed:

The aqueous solution of (A1.2) and (A2.2), see I., was provided, total solids content: 40.6%, temperature: 20° C.

Granulation was performed in a spouted bed apparatus. A vessel containing a fluidized bed from 710 g of solid MGDA-$Na_3$ granule, initial average particle diameter 550 μm, and 300 g MGDA-$Na_3$ granule, milled down to a maximum diameter of 500 μm, average: 150 μm, was provided. The fluidization was accomplished by entering 200 $Nm^3$/h so-called fluidization gas at the bottom of the vessel, said fluidization gas being air with an inlet temperature of 165° C.

As soon as the bed temperature of at least 105° C. was reached, an amount of 4.5 kg/h of the above aqueous solution of (A.1) and (A.2) was sprayed onto the fluidized bed with the help of a nozzle. The spraying—and thus atomizing—was accomplished with 8 $Nm^3$/h air with a gas inlet temperature of 20° C., 4 bar.

Continuously, 3.1 kg/h of solid material were withdrawn from the vessel through a zigzag classifier with 1 bar. The zigzag classifier was located in front of the spouted bed and below the level of the fluidized bed and the nozzle. Only very few lumps were obtained. 30 to 40% by weight of the solid material were milled down to a maximum diameter of 500 μm, average diameter: 150 μm, in a hammer mill, type Kinematica Polymix System PM-MFC 90 D, and returned portionwise into the granulator.

A free-flowing granule of (A1.2) and (A2.2) was obtained that had excellent properties such as, but not limited to excellent percarbonate stability and low hygroscopicity. No hot spots were observed during processing. No sticky material was obtained. A free flowing granule was obtained, and the hygroscopicity was low.

Water content according to Karl-Fischer: 9.41% by weight.

10 g of granule of (A1.2) and (A2.2) were mixed by shaking it with 5 g sodium percarbonate. The mixture so obtained were placed in a 50 ml bottle. The bottle was covered with a lid that had a whole of 4 mm diameter. The mixture was stored at 35° C. and 78% relative humidity. The mixture was shaken once a week for homogenization purposes. After 5 weeks, the change of colour (from white to yellow) was measured with a spectrophotometer (Elrepho).

The results are summarized in Table 2.

TABLE 2 results of peroxide test

| | Residual water [% by weight] | Bulk density [g/l | immediately | 35 d |
|---|---|---|---|---|
| MGDA-$Na_3$, 22% ee | 13 | n.d. | 6.4 | 38.7 |
| (A1.1) and (A2.1) | 9.41 | 882 | 7.8 | 19.5 |

Tablets were formed from inventive granule with a tablet press, make: Korsch XP1. The following conditions were applied:

TABLE 3

Experimental conditions for tablet manufacture

| | Xi/n | ± |
|---|---|---|
| Compaction force [kN] | 43.77 | 1.14 |
| Compaction pressure [MPa] | 89.17 | 2.33 |
| Tensile strength [MPa] | 0.17 | 0.01 |
| Plasticity [%] | 100.00 | 0.00 |
| Ejection force [kN] | 0.48 | 0.27 |

From the combination of (A1.1) and (A2.1) tablets according to the present invention are formed. From granule of MGDA-$Na_3$, comparative tablets are made. Tablets according to the invention are more stable to impacts and dissolve rapidly in water.

The invention claimed is:

1. A process for manufacturing granules of salts of at least two aminopolycarboxylic acids (A), the process comprising:

spray granulating, with a gas inlet temperature of at least 125° C., an aqueous solution comprising (A1) an alkali metal salt of a mixture of L- and D-enantiomers of methyl glycine diacetic acid (MGDA), the mixture comprising predominantly the L-enantiomer with an enantiomeric excess (ee) in a range of from 10 to 95%, and (A2) an alkali metal salt of a mixture of L- and D-enantiomers of glutamic acid diacetic acid (GLDA) or of enantiomerically pure L-GLDA, wherein a weight ratio of (A1) and (A2) is in a range of from 1:9 to 9:1.

2. The process of claim 1, wherein the aqueous solution has a concentration of the aminopolycarboxylic acids (A) in a range of from 45 to 65% by weight.

3. The process of claim 1, wherein the spray granulating is performed in a fluidized bed or a spouted bed.

4. The process of claim 1, wherein the alkali metal salts comprise fully neutralized sodium and potassium salts of MGDA and GLDA.

5. The process of claim 3, wherein the spray granulating is performed in a fluidized bed comprising particles having an average diameter (D50) in a range of from 100 to 800 μm.

6. The process of claim 1, wherein the aqueous solution subjected to spray-granulation further comprises silica, a silicate, an organic polymer, an organic copolymer, or a mixture of two or more of these.

7. The process of claim 1, wherein the alkali metal salt of (A1) comprises a compound of formula (I)

$$[CH_3—CH(COO)—N(CH_2—COO)_2]M_{3-x}H_x \quad (I),$$

wherein

M is an alkali metal cation, and x is in a range of from 0 to 1.

8. A granule, comprising, in molecular disperse form:

(A1) an alkali metal salt of a mixture of L- and D-enantiomers of methyl glycine diacetic acid (MGDA), said mixture comprising predominantly the L-enantiomer with an enantiomeric excess (ee) in a range of from 10 to 95%, and (A2) an alkali metal salt of L- and D-enantiomers of glutamic acid diacetic acid (GLDA) or of enantiomerically pure L-GLDA, wherein a weight ratio of (A1) and (A2) is in a range of from 1:9 to 9:1, and wherein the granule has a residual moisture content in a range of from 5 to 15% by weight.

9. The granule of claim 8, having an average diameter (D50) in a range of from 350 to 900 μm.

10. A solid hard surface cleaner, comprising the granule of claim 8 in a range of from 1 to 50 wt. %.

11. The hard surface cleaner of claim 10, which is an automatic dishwashing detergent.

12. A process for making tablets, the process comprising: pelletizing a mixture comprising the granule of claim 8.

13. The process of claim 1, wherein the aqueous solution has a pH value in a range of from 8 to 14.

14. The process of claim 1, wherein the aqueous solution has a pH value in a range of from 9 to 13.5.

15. The process of claim 1, wherein the alkali metal salts comprise fully neutralized potassium salts of MGDA and GLDA.

16. The process of claim 1, wherein the alkali metal salts comprise fully neutralized sodium salts of MGDA and GLDA.

17. The process of claim 1, wherein the granules have an average particle diameter (D50) in a range of from 0.1 mm to 2 mm.

18. The process of claim 1, wherein the aqueous solution has a total solids contents in a range of from 30 to 70 wt. %.

19. The process of claim 1, wherein the aqueous solution has a total solids contents in a range of from 45 to 65%.

20. The process of claim 1, wherein the spray-drying comprises removing 51 to 75 wt. % of the water present in the aqueous solution.

21. A solid laundry detergent, comprising the granule of claim 8 in a range of from 1 to 30 wt. %.

* * * * *